US007862305B2

(12) United States Patent
Yamamuro et al.

(10) Patent No.: US 7,862,305 B2
(45) Date of Patent: Jan. 4, 2011

(54) VARIABLE DISPLACEMENT VANE PUMP

(75) Inventors: Sigeaki Yamamuro, Kanagawa (JP); Hideo Konishi, Saitama (JP); Fusao Semba, Saitama (JP)

(73) Assignee: Hitachi, Ltd., Tokyo (JP)

( * ) Notice: Subject to any disclaimer, the term of this patent is extended or adjusted under 35 U.S.C. 154(b) by 1079 days.

(21) Appl. No.: 11/602,274

(22) Filed: Nov. 21, 2006

(65) Prior Publication Data

US 2007/0148029 A1 Jun. 28, 2007

(30) Foreign Application Priority Data

Dec. 26, 2005 (JP) ..... 2005-371332

(51) Int. Cl.
*F04B 49/00* (2006.01)
*F01C 20/22* (2006.01)

(52) U.S. Cl. ..... 417/220; 418/30

(58) Field of Classification Search ..... 417/220; 418/23, 28, 30, 31
See application file for complete search history.

(56) References Cited

U.S. PATENT DOCUMENTS 6,217,296 B1 4/2001 Miyazawa et al.
6,616,419 B2 9/2003 Watanabe et al.
6,709,242 B2 * 3/2004 Watanabe et al. ..... 417/220
6,976,830 B2 12/2005 Uchino
2006/0034721 A1 2/2006 Uchino

FOREIGN PATENT DOCUMENTS

JP 2003-74479 3/2003

OTHER PUBLICATIONS

Chinese Office Action for corresponding Chinese Patent Application No. 200610171166.5, dated May 23, 2008 (English translation).
U.S. Appl. No. 12/048,773, filed Mar. 14, 2008, Yamamuro et al.

* cited by examiner

*Primary Examiner*—Devon C Kramer
*Assistant Examiner*—Philip Stimpert
(74) *Attorney, Agent, or Firm*—Foley & Lardner LLP

(57) ABSTRACT

A variable displacement vane pump, including a pump body, a driving shaft, a rotor, a cam ring swingable around a swing fulcrum, first and second support members on opposite axial sides of the cam ring, a suction port and a discharge port disposed on at least one of the support members, a seal dividing a space on an outer circumferential side of the cam ring into a first fluid pressure chamber defined in a direction in which the cam ring is swung to cause increase in a flow rate of a working fluid discharged, and a second fluid pressure chamber defined in a direction in which the cam ring is swung to cause decrease in the flow rate of the working fluid discharged, and a plunger biasing the cam ring from a side of the second fluid pressure chamber toward a side of the first fluid pressure chamber.

30 Claims, 13 Drawing Sheets

VARIABLE DISPLACEMENT VANE PUMP

BACKGROUND OF THE INVENTION

The present invention relates to an improvement of a variable displacement vane pump which serves as a hydraulic power source of a hydraulic device such as a power steering apparatus for vehicles.

Japanese Patent Application First Publication No. 2003-74479 discloses a variable displacement vane pump which is applied to a power steering apparatus for vehicles. The variable displacement vane pump of the conventional art includes an adaptor ring fixedly disposed within a pump body, a cam ring which is disposed inside the adaptor ring and swingable about a swing fulcrum on an inner circumferential surface of the adaptor ring, and a rotor which is rotatably disposed inside the cam ring and integrally formed with a drive shaft extending in the pump body. A plurality of radially extending slots are formed at predetermined circumferential intervals in an outer circumferential periphery of the rotor. A plurality of vanes are radially moveably fitted into the respective slots so as to project from the slots and retreat into the slots. Opposed side plates support the cam ring and the rotor therebetween in an axial direction of the rotor. A first fluid pressure chamber and a second fluid pressure chamber are disposed between the adaptor ring and the cam ring in a radially opposed relation to each other. The first fluid pressure chamber is constructed to introduce working fluid having a pressure which is controlled by a control valve. The second fluid pressure chamber is constructed to always introduce a low-pressure fluid from a suction side of the vane pump. This serves for reducing a loss in discharge pressure of the second fluid pressure chamber. The cam ring is swung depending on a relative pressure between the fluid pressure in the first fluid pressure chamber and the spring force of a spring provided on a side of the second fluid pressure chamber. The swing motion of the cam ring causes change in volume of pump chambers each formed between the circumferentially adjacent vanes to thereby control a flow rate of the working fluid discharged by the vane pump. When the vane pump is operated at high speed, the cam ring is swung toward the second fluid pressure chamber to thereby decrease the flow rate of the working-fluid discharged by the vane pump and serve for reducing energy loss thereof.

SUMMARY OF THE INVENTION

However, since the vane pump of the above-described conventional art is of a so-called low-pressure type in which the second fluid pressure chamber always receives a low-pressure fluid from the suction side, a cam ring-supporting force of the second fluid pressure chamber which is produced by the low-pressure fluid introduced into the second fluid pressure chamber is reduced. Specifically, in the low-pressure type variable displacement vane pump, the cam ring supporting force becomes small to thereby bring the cam ring to a unstable state thereof, as compared to a high-pressure type variable displacement vane pump in which the second fluid pressure chamber receives a pump discharge pressure and the swing motion of the cam ring is controlled depending on a pressure difference between the pump discharge pressure in the second fluid pressure chamber and the fluid pressure in the first fluid pressure chamber. For example, even in a low rotation range of the low-pressure type variable displacement vane pump in which a large discharge flow rate is necessary, the cam ring will be adversely inclined toward the second fluid pressure chamber, causing reduction of the discharge flow rate of the low-pressure type variable displacement vane pump.

It is an object of the present invention to solve the above-described problems in the technologies of the conventional art and to provide a variable displacement vane pump which can suppress adverse inclination of the cam ring by enhancing a cam ring supporting force of the second fluid pressure chamber to thereby prevent reduction of the discharge flow rate of the variable displacement vane pump.

The other objects and features of this invention will become understood from the following description with reference to the accompanying drawings.

In one aspect of the present invention, there is provided a variable displacement vane pump, comprising:

a pump body;

a driving shaft supported on the pump body;

a rotor disposed within the pump body and rotatably driven by the driving shaft, the rotor including a plurality of vanes arranged in a circumferential direction of the rotor;

an annular cam ring disposed within the pump body so as to be swingable around a swing fulcrum, the cam ring cooperating with the rotor and the vanes to define a plurality of pump chambers on an inner circumferential side of the cam ring;

a first support member disposed at one axial end of the cam ring;

a second support member disposed at an opposite axial end of the cam ring;

a suction port and a discharge port which are disposed on at least one of the first and second support members, the suction port being open to a suction area in which a volume of each of the pump chambers is gradually increased with the rotation of the rotor, the discharge port being open to a discharge area in which the volume of each of the pump chambers is gradually decreased with the rotation of the rotor;

a seal disposed on an outer circumferential side of the cam ring so as to divide a space on the outer circumferential side of the cam ring into a first fluid pressure chamber and a second fluid pressure chamber, the first fluid pressure chamber being defined in a swing direction of the cam ring in which the cam ring is swung to cause increase in a flow rate of a working fluid which is discharged from the discharge port, the second fluid pressure chamber being defined in a swing direction of the cam ring in which the cam ring is swung to cause decrease in the flow rate of the working fluid which is discharged from the discharge port, the second fluid pressure chamber receiving at least a fluid pressure which is sucked from the suction port; and a plunger which biases the cam ring from a side of the second fluid pressure chamber toward a side of the first fluid pressure chamber.

In a further aspect of the invention, there is provided a variable displacement vane pump, comprising:

a pump body;

a driving shaft supported on the pump body;

a rotor disposed within the pump body and rotatably driven by the driving shaft, the rotor including a plurality of vanes arranged in a circumferential direction of the rotor;

an annular cam ring disposed within the pump body so as to be swingable around a swing fulcrum, the cam ring cooperating with the rotor and the vanes to define a plurality of pump chambers on an inner circumferential side of the cam ring;

a first support member disposed at one axial end of the cam ring;

a second support member disposed at an opposite axial end of the cam ring;

a suction port and a discharge port which are disposed on at least one of the first and second support members, the suction port being open to a suction area in which a volume of each of the pump chambers is gradually increased with the rotation of the rotor, the discharge port being open to a discharge area in which the volume of each of the pump chambers is gradually decreased with the rotation of the rotor;

a seal disposed on an outer circumferential side of the cam ring so as to divide a space on the outer circumferential side of the cam ring into a first fluid pressure chamber and a second fluid pressure chamber, the first fluid pressure chamber being defined in a swing direction of the cam ring in which the cam ring is swung to cause increase in a flow rate of a working fluid which is discharged from the discharge port, the second fluid pressure chamber being defined in a swing direction of the cam ring in which the cam ring is swung to cause decrease in the flow rate of the working fluid which is discharged from the discharge port, the second fluid pressure chamber receiving at least a fluid pressure which is sucked from the suction port;

a metering orifice disposed on a downstream side of the discharge port;

a control valve which receives a pressure difference between upstream and downstream sides of the metering orifice; and a plunger which receives a fluid pressure controlled by the control valve and biases the cam ring from a side of the second fluid pressure chamber toward a side of the first fluid pressure chamber.

In a still further aspect of the invention, there is provided a variable displacement vane pump, comprising:

a pump body;

a driving shaft supported on the pump body;

a rotor disposed within the pump body and rotatably driven by the driving shaft, the rotor including a plurality of vanes arranged in a circumferential direction of the rotor;

an annular cam ring disposed within the pump body so as to be swingable around a swing fulcrum, the cam ring cooperating with the rotor and the vanes to define a plurality of pump chambers on an inner circumferential side of the cam ring;

a first support member disposed at one axial end of the cam ring;

a second support member disposed at an opposite axial end of the cam ring;

a suction port and a discharge port which are disposed on at least one of the first and second support members, the suction port being open to a suction area in which a volume of each of the pump chambers is gradually increased with the rotation of the rotor, the discharge port being open to a discharge area in which the volume of each of the pump chambers is gradually decreased with the rotation of the rotor;

a seal disposed on an outer circumferential side of the cam ring so as to divide a space on the outer circumferential side of the cam ring into a first fluid pressure chamber and a second fluid pressure chamber, the first fluid pressure chamber being defined in a swing direction of the cam ring in which the cam ring is swung to cause increase in a flow rate of a working fluid which is discharged from the discharge port, the second fluid pressure chamber being defined in a swing direction of the cam ring in which the cam ring is swung to cause decrease in the flow rate of the working fluid which is discharged from the discharge port; and a plunger provided on the cam ring, the plunger biasing the cam ring from a side of the second fluid pressure chamber toward a side of the first fluid pressure chamber.

In a still further aspect of the invention, there is provided a variable displacement vane pump, comprising:

a pump body;

a driving shaft supported on the pump body;

a rotor disposed within the pump body and rotatably driven by the driving shaft, the rotor including a plurality of vanes arranged in a circumferential direction of the rotor;

an annular cam ring disposed within the pump body so as to be swingable around a swing fulcrum, the cam ring cooperating with the rotor and the vanes to define a plurality of pump chambers on an inner circumferential side of the cam ring;

a first support member disposed at one axial end of the cam ring;

a second support member disposed at an opposite axial end of the cam ring;

a suction port and a discharge port which are disposed on at least one of the first and second support members, the suction port being open to a suction area in which a volume of each of the pump chambers is gradually increased with the rotation of the rotor, the discharge port being open to a discharge area in which the volume of each of the pump chambers is gradually decreased with the rotation of the rotor;

a seal disposed on an outer circumferential side of the cam ring so as to divide a space on the outer circumferential side of the cam ring into a first fluid pressure chamber and a second fluid pressure chamber, the first fluid pressure chamber being defined in a swing direction of the cam ring in which the cam ring is swung to cause increase in a flow rate of a working fluid which is discharged from the discharge port, the second fluid pressure chamber being defined in a swing direction of the cam ring in which the cam ring is swung to cause decrease in the flow rate of the working fluid which is discharged from the discharge port, the second fluid pressure chamber receiving at least a fluid pressure which is sucked from the suction port; and cam ring biasing means for biasing the cam ring from a side of the second fluid pressure chamber toward a side of the first fluid pressure chamber.

DETAILED DESCRIPTION OF THE INVENTION

Figure 1:
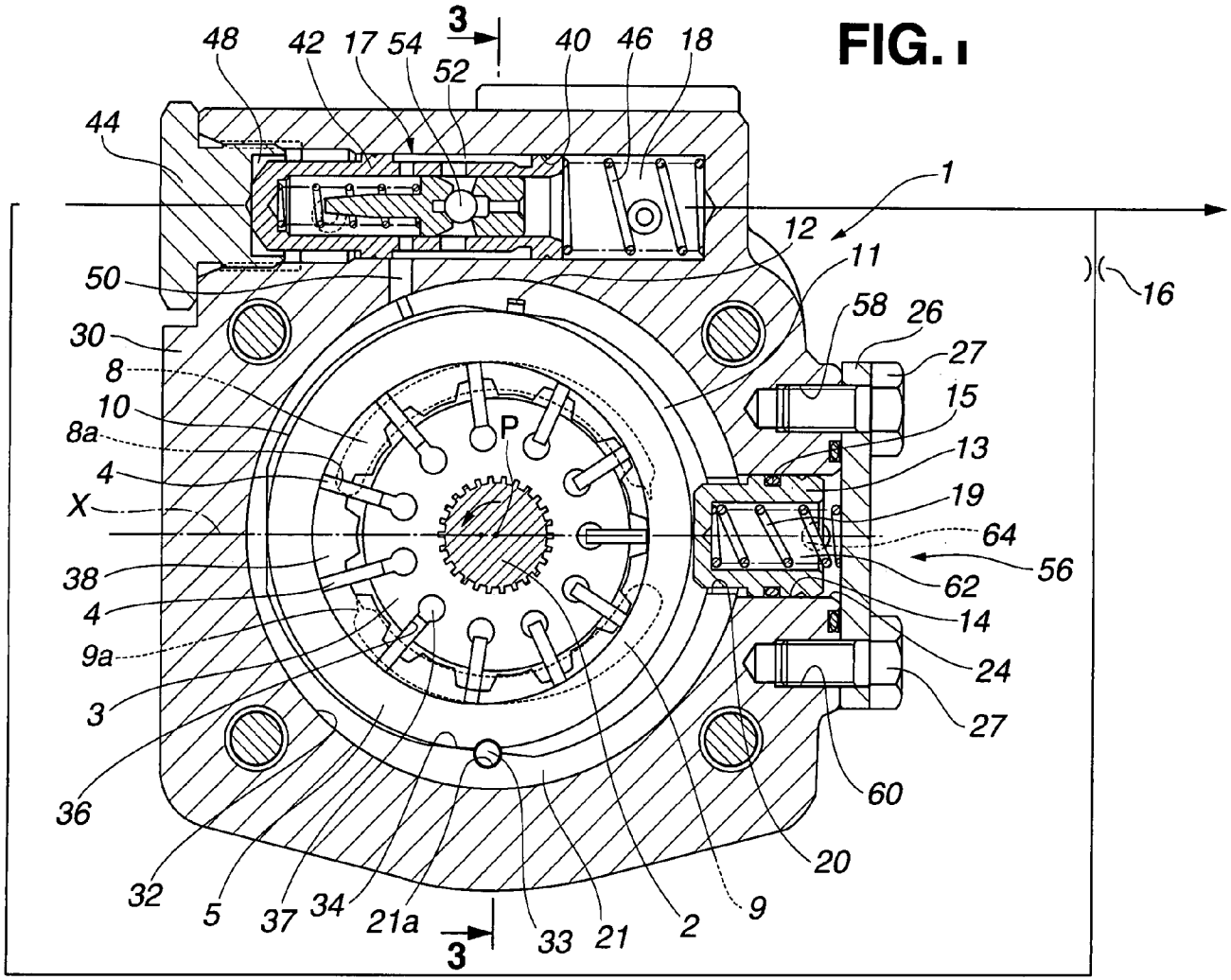
FIG. 1 is a cross-section taken along line 1-1 of FIG. 3, showing a first embodiment of a variable displacement vane pump according to the present invention.
Figure 2:
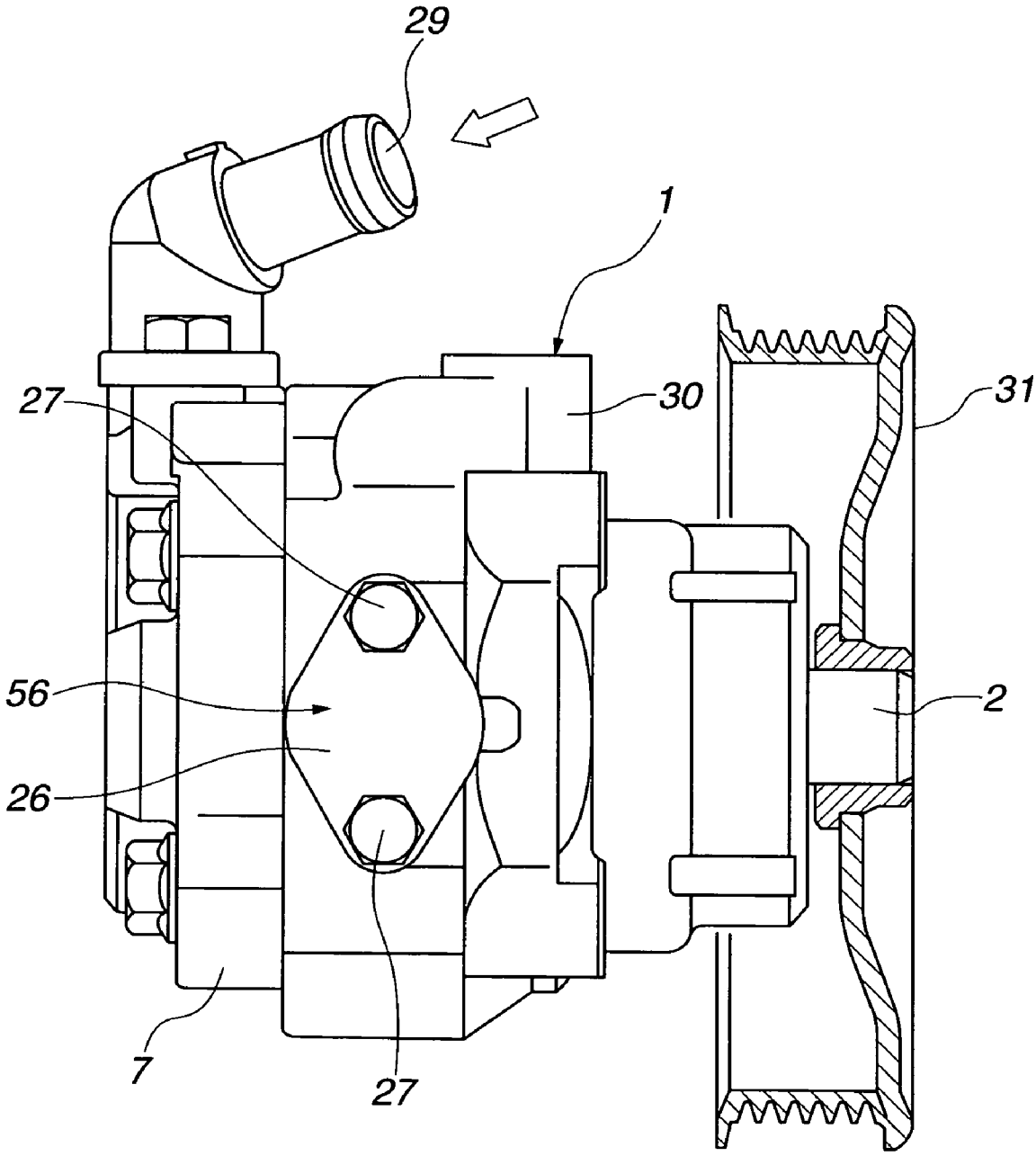
FIG. 2 is a side view of the variable displacement vane pump shown in FIG. 1, showing a part thereof in cross-section.
Figure 3:
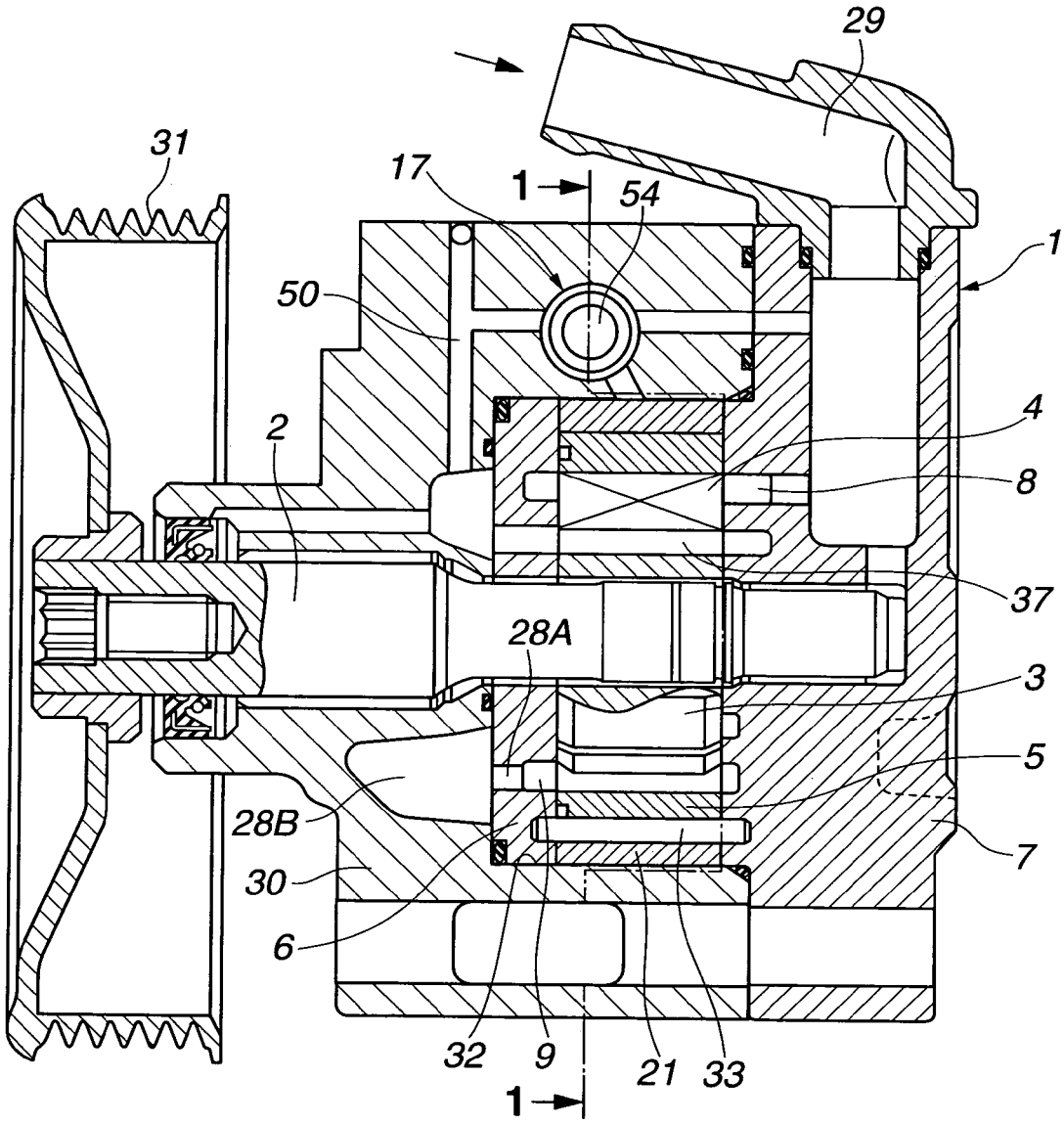
FIG. 3 is a longitudinal section taken along line 3-3 of FIG. 1.

Referring now to FIGS. 1-4, a first embodiment of a variable displacement vane pump according to the present invention, is explained. In this embodiment, the variable displacement vane pump serves as a hydraulic power source of a power steering apparatus for vehicles. As illustrated in FIG. 1, the variable displacement vane pump includes pump body 1 and driving shaft 2 which is supported on pump body 1 so as to be rotatable about rotation axis P. Driving shaft 2 is rotatably connected to an engine crankshaft, not shown, through driven pulley 31 shown in FIGS. 2 and 3. As illustrated in FIGS. 2 and 3, pump body 1 includes front body 30 and rear body 7 which are coupled with each other in an axial direction of driving shaft 2. Front body 30 and rear body 7 cooperate with each other to form inside space 32 shown in FIG. 1.

Rotor 3 is disposed within inside space 32 of pump body 1 and driven by driving shaft 2 so as to be rotatable in a counterclockwise direction as indicated by arrow in FIG. 1. A plurality of slots 13 are formed in an outer circumferential periphery of rotor 3 and equidistantly spaced from each other. Each of slots 13 extends in a radial direction of rotor 3 and is continuously connected with back pressure chamber 37 which has a generally circular section. Vane 4 is disposed in slot 13 so as to be movable in the radial direction of rotor 3.

Cam ring 5 having an annular shape is disposed on an outside of rotor 3 within inside space 32 of pump body 1 and eccentrically moveable with respect to rotor 3. Cam ring 5 cooperates with rotor 3 and vanes 4 to define a plurality of pump chambers 38 therebetween. Pump chambers 38 are arranged on an inner circumferential side of cam ring 5, each thereof being formed between two adjacent vanes 4. Cam ring 5 is swingable about a swing fulcrum which is located in a predetermined position on support surface 34 of adapter ring 21 as explained later.

As illustrated in FIG. 3, pressure plate 6 is disposed on a bottom of inside space 32 of pump body 1. Pressure plate 6 is formed into a generally disk shape. Rotor 3 and cam ring 5 are interposed between pressure plate 6 and rear body 7. Opposite axial end faces of cam ring 5 are supported by pressure plate 6 and rear body 7. Similarly, opposite axial end faces of rotor 3 are supported by pressure plate 6 and rear body 7. Thus, pressure plate 6 and rear body 7 serve as support members for supporting rotor 3 and cam ring 5, respectively.

Suction port 8 and discharge port 9 are disposed on at least one of pressure plate 6 and rear body 7. In this embodiment, as shown in FIG. 3, suction port 8 is formed on an inner surface of rear body 7 which is opposed to one axial end face of rotor 3, and discharge port 9 and discharge hole 28A communicated with discharge port 9 are formed in a surface of pressure plate 6 which is opposed to the other axial end face of rotor 3. Suction port 8 is formed into an arcuate shape as shown in FIG. 1 and is open to a suction area in which the volume of each of pump chambers 38 is gradually increased with the rotation of rotor 3. The working fluid sucked from a reservoir tank is supplied to each of pump chambers 38 through suction port 8 and suction passage 29 shown in FIGS. 2 and 3. Discharge port 9 is formed into an arcuate shape as shown in FIG. 1 and is open to a discharge area in which the volume of each of pump chambers 38 is gradually decreased with the rotation of rotor 3. The working fluid discharged from pump chambers 38 passes through discharge port 9 and discharge hole 28A and is introduced into discharge-side pressure chamber 28B which is formed in front body 30. The working fluid introduced into discharge-side pressure chamber 28B is flown into a discharge passage, not shown, which is formed in pump body 1, and then is transmitted to a hydraulic power cylinder of the power steering apparatus via piping.

Adapter ring 21 having an annular shape is fitted into inside space 32 of pump body 1. As illustrated in FIG. 1, adapter ring 21 includes a generally elliptic bore in which cam ring 5 is swingably disposed. Adapter ring 21 has pin support groove 21*a* on an inner circumferential surface thereof, which has an arcuate section as shown in FIG. 1 and receives positioning pin 33 for holding cam ring 5 in place. Positioning pin 33 also acts as a stop for restricting a swing motion of cam ring 5 with respect to adapter ring 21. Adapter ring 21 has support surface 34 on an inner circumferential surface thereof on which the swing fulcrum of cam ring 5 is located. As cam ring 5 is swung about the swing fulcrum in one swing direction or an opposite swing direction, a volume of each of pump chambers 38 is changed to increase or decrease. Support surface 34 is located on a side of first fluid pressure chamber 10 as explained later, namely, located on the left side of positioning pin 33 as shown in FIG. 1.

Seal 12 is disposed on an outer circumferential side of cam ring 5 in substantially radially opposed relation to positioning pin 33. Seal 12 divides a space on the outer circumferential side of cam ring 5 which is defined between cam ring 5 and adapter-ring 21 into first fluid pressure chamber 10 and second fluid pressure chamber 11. Cam ring 5 is swingable around the swing fulcrum on support surface 34 of adapter ring 21 so as to move toward the side of first fluid pressure chamber 10 or the side of second fluid pressure chamber 11. First fluid pressure chamber 10 is defined in the one swing direction of cam ring 5 in which cam ring 5 is swung to cause increase in the flow rate of the working fluid discharged by the vane pump. Second fluid pressure chamber 11 is defined in the opposite swing direction of cam ring 5 in which cam ring 5 is swung to cause decrease in the flow rate of the working fluid discharged by the vane pump.

Support surface 34 has a predetermined surface area which extends from an outer periphery of pin support groove 21*a* toward the side of first fluid pressure chamber 10. Support surface 34 is downwardly inclined toward the side of second fluid pressure chamber 11 with respect to imaginary reference plane X which extends through rotation axis P of driving shaft 2 and a middle point between terminal end 8*a* of suction port 8 and start end 9*a* of discharge port 9. Namely, support surface 34 is inclined toward the side of second fluid pressure chamber 11 with respect to imaginary reference plane X such that a distance between support surface 34 and imaginary reference plane X is gradually increased. The inclination angle is set to several degrees with respect to imaginary reference plane X.

Cam ring biasing mechanism 56 for biasing cam ring 5 from the side of second fluid pressure chamber 11 toward the side of first fluid pressure chamber 10 is disposed on imaginary reference plane X in front body 30 on the side of second fluid pressure chamber 11. Cam ring biasing mechanism 56 includes plunger 13, a large-diameter plunger accommodating bore 14 and small-diameter plunger accommodating bore 20 which are continuously connected with each other to form a united plunger accommodating bore for receiving plunger 13, coil spring 19 which urges plunger 13 toward cam ring 5, and lid 26 which covers open end 24 of large-diameter plunger accommodating bore 14.

Figure 4:
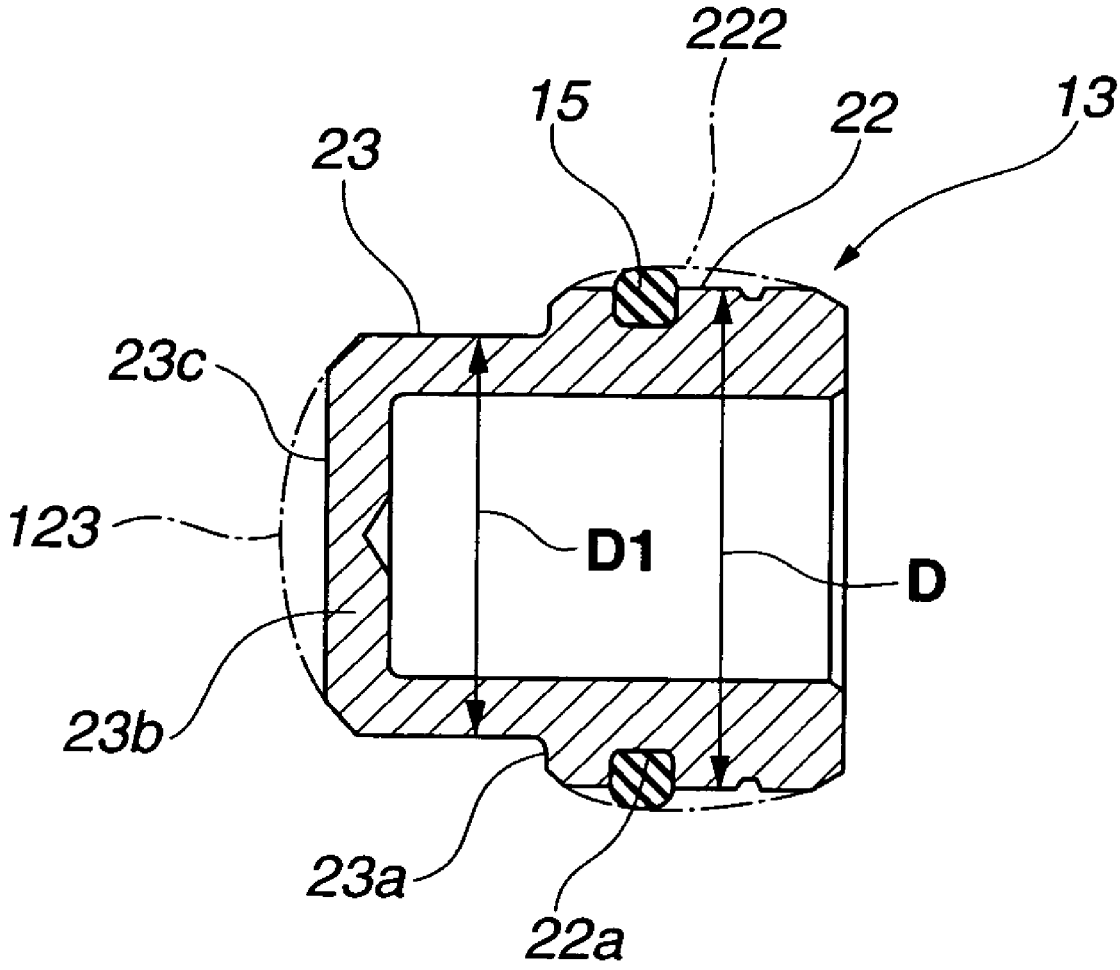
FIG. 4 is a longitudinal section of a plunger used in the first embodiment of the variable displacement vane pump, partially showing modification of the plunger.

Plunger 13 is formed into a hollow generally cylindrical shape with one closed-end. Plunger 13 is slidably disposed in the united plunger accommodating bore in an axial direction of the united plunger accommodating bore. Plunger 13 is made of a suitable metal, for instance, an aluminum alloy having the same value of coefficient of linear expansion as that of front body 30. As illustrated in FIG. 4, plunger 13 includes cylindrical body portion 22 and cylindrical end portion 23 connected with body portion 22.

Specifically, body portion 22 of plunger 13 is slidably disposed in large-diameter plunger accommodating bore 14. Body portion 22 has outer diameter D which is slightly smaller than an inner diameter of large-diameter plunger accommodating bore 14 so as to ensure a good slidability with respect to large-diameter plunger accommodating bore 14. Body portion 22 is formed with annular groove 22*a* into which annular seal 15 is fixedly fitted. Seal 15 cooperates with large-diameter plunger accommodating bore 14, body portion 22 of plunger 13 and lid 26 to define pressure receiving chamber 62 therebetween and seals pressure receiving chamber 62. A cylindrical bore of hollow plunger 13 constitutes a part of pressure receiving chamber 62. End portion 23 of plunger 13 extends toward cam ring 5 through small-diameter plunger accommodating bore 20. End portion 23 has outer diameter D1 which is slightly smaller than outer diameter D of body portion 22 of plunger 13. End portion 23 extends toward cam ring 5 through small-diameter plunger accommodating bore 20. A step between body portion 22 and end portion 23 acts as stop 23*a* which abuts on a stepped surface between an inner circumferential surface of large-diameter plunger accommodating bore 14 and an inner circumferential surface of small-diameter plunger accommodating bore 20 and restricts the projecting motion of end portion 23 when plunger 13 moves toward cam ring 5. End portion 23 further includes disk-shaped end wall 23*b* which is exposed to second fluid pressure chamber 11. Planar end surface 23*c* of end wall 23*b* is contacted with an outer circumferential surface of cam ring 5.

As illustrated in FIG. 1, large-diameter plunger accommodating bore 14 is formed in a side wall of front body 30. Large-diameter plunger accommodating bore 14 extends through the side wall of front body 30 along imaginary reference plane X. Large-diameter plunger accommodating bore 14 has an inner open end exposed to inside space 32 of pump body 1 and outer open end 24 which is open to the outer surface of the side wall of front body 30 and exposed to an outside of pump body 1. Outer open end 24 is covered with lid 26. Lid 26 is in the form of a plate having a rhombus shape as shown in FIG. 2. As illustrated in FIGS. 1 and 2, upper and lower corner portions of rhombus-shaped lid 26 are fixed to the side wall of front body 30 by means of a plurality of bolts, specifically, two bolts 27, 27 in this embodiment. Each of bolts 27, 27 is arranged on an imaginary plane substantially perpendicular to driving shaft 2 and extends in a direction substantially parallel to imaginary reference plane X without largely projecting from the side wall of front body 30. Bolts 27, 27 are screwed into bolt holes 58, 60 which are formed in the side wall of front body 30 on upper and lower sides of imaginary reference plane X and extend substantially parallel to imaginary reference plane X. Small-diameter plunger accommodating bore 20 having a diameter slightly smaller than a diameter of large-diameter plunger accommodating bore 14 is formed in a circumferential wall of adapter ring 21. Small-diameter plunger accommodating bore 20 extends through the circumferential wall of adapter ring 21 in a radial direction of adapter ring 21 along imaginary reference plane X. Small-diameter plunger accommodating bore 20 is arranged in a concentric relation to large-diameter plunger accommodating bore 14 and communicated with large-diameter plunger accommodating bore 14.

Coil spring 19 as a resilient member is accommodated in pressure receiving chamber 62. One end of coil spring 19 is contacted with an inner surface of end wall 23*b* of plunger 13 which defines a bottom of the cylindrical bore of plunger 13. The other end of coil spring 19 is contacted with an inside surface of lid 26 which is opposed to the cylindrical bore of plunger 13. Coil spring 19 has a preset spring force which is exerted onto plunger 13 in such a direction as to project from the plunger accommodating bore toward cam ring 5 and keep the contact between end wall 23*b* of plunger 13 and cam ring 5. Cam ring 5, therefore, is always biased by plunger 13 from the side of second fluid pressure chamber 11 toward the side of first fluid pressure chamber 10, namely, in a direction in which the volume of each of pump chamber 38 is increased to the maximum.

In addition to the spring force of coil spring 19, the high fluid pressure of the working fluid discharged from discharge port 9 is applied to plunger 13, so that plunger 13 is allowed to bias cam ring 5 toward the side of first fluid pressure chamber 10. Specifically, pressure receiving chamber 62 is communicated with discharge port 9 through pressure introduction passage 64 which is formed in front body 30. Pressure introduction passage 64 has one end open to pressure receiving chamber 62 as indicated by broken line in FIG. 1. The other end of pressure introduction passage 64 is open to discharge port 9. The high fluid pressure of the working fluid discharged from discharge port 9 is introduced into pressure receiving chamber 62 through pressure introduction passage 64 to thereby act on the inner surface of end wall 23*b* of plunger 13 and urge plunger 13 toward cam ring 5.

Metering orifice 16 is disposed on a downstream side of discharge port 9. Control valve 17 is disposed within front body 30 and operated by a pressure difference between upstream and downstream sides of metering orifice 16 and controls at least a fluid pressure to be introduced in first fluid pressure chamber 10. Control valve 17 is arranged such that the valve axis, i.e., a central axis of valve bore 40, extends perpendicular to driving shaft 2. Control valve 17 includes spool 42 which is disposed within valve bore 40 so as to be slidable in the axial direction of valve bore 40. Plug 44 is fitted into one axial end portion of valve bore 40 and closes the one axial end portion. Valve spring 46 is disposed within the other axial end portion of valve bore 40. Valve spring 46 is disposed in spring accommodating chamber 18 between a bottom of valve bore 40 and an axial end portion of spool 42 and biases spool 42 such that an opposite axial end portion of spool 42 is contacted with plug 44. The fluid pressure on a downstream side of metering orifice 16 is introduced into spring accommodating chamber 18. Spring accommodating chamber 18 is hereinafter referred to as downstream pressure chamber 18. High-pressure chamber 48 is disposed between plug 44 and the opposite axial end portion of spool 42. The fluid pressure on an upstream side of metering orifice 16 is introduced into high-pressure chamber 48. When a pressure difference between the fluid pressure in high-pressure chamber 48 and the fluid pressure in downstream pressure chamber 18 becomes a predetermined value or more, spool 42 is urged to move against the spring force of valve spring 46 toward the bottom of valve bore 40, namely, in the rightward direction as viewed in FIG. 1. Control valve 17 further includes relief valve 54 disposed within spool 42. Relief valve 54 is configured to be open and release the working fluid when the fluid pressure in downstream pressure chamber 18 becomes a predetermined value or more, namely, when an operating pressure of the power steering apparatus becomes a predetermined value or more.

When spool 42 is located in a position on the left side of valve bore 40 as shown in FIG. 1, first fluid pressure chamber 10 is in fluid communication with valve suction chamber 52 which is defined between an outer circumferential surface of spool 42 and an inner circumferential surface of valve bore 40, through communication passage 50 formed in front body 30. Valve suction chamber 52 is supplied with a low-pressure fluid from suction port 8 through a suction hole, not shown, which is formed in front body 30. Further, when spool 42 is urged to move to a rightward position through the position shown in FIG. 5 due to the above-described pressure difference, the fluid communication between first fluid pressure chamber 10 and valve suction chamber 52 is prevented and the fluid communication between first fluid pressure chamber 10 and high-pressure chamber 48 is established so that the high fluid pressure in high-pressure chamber 48 is introduced into first fluid pressure chamber 10. Thus, the low fluid pressure in valve suction chamber 52 and the high fluid pressure in high-pressure chamber 48 is selectively supplied to first fluid pressure chamber 10.

On the other hand, second fluid pressure chamber 11 is not directly communicated with control valve 17 and communicated with suction passage 29 via a pressure introduction hole formed in pressure plate 6. Thus, second fluid pressure chamber 11 always receives the low fluid pressure of the working fluid from the suction side. Second fluid pressure chamber 11 may receive a slight fluid pressure of the working fluid from the discharged side.

When the thus-constructed vane pump is operated at low rotational speed, the low fluid pressure on the suction side is introduced into first fluid pressure chamber 10 via valve suction chamber 52 of control valve 17, and the low fluid pressure on the suction side is introduced into second fluid pressure chamber 11 via suction passage 29. In this condition, cam ring 5 is biased by plunger 13 of cam ring biasing mechanism 56 to thereby be swung around the swing fulcrum on support surface 34 toward the side of first fluid pressure chamber 10 and placed in a maximum swing position as shown in FIG. 1. In the maximum swing position, the eccentric amount of cam ring 5 with respect to rotor 3 is the maximum, whereby the discharge flow rate of the vane pump is increased and the fluid pressure on the side of discharge portion 9 becomes large.

Figure 5:
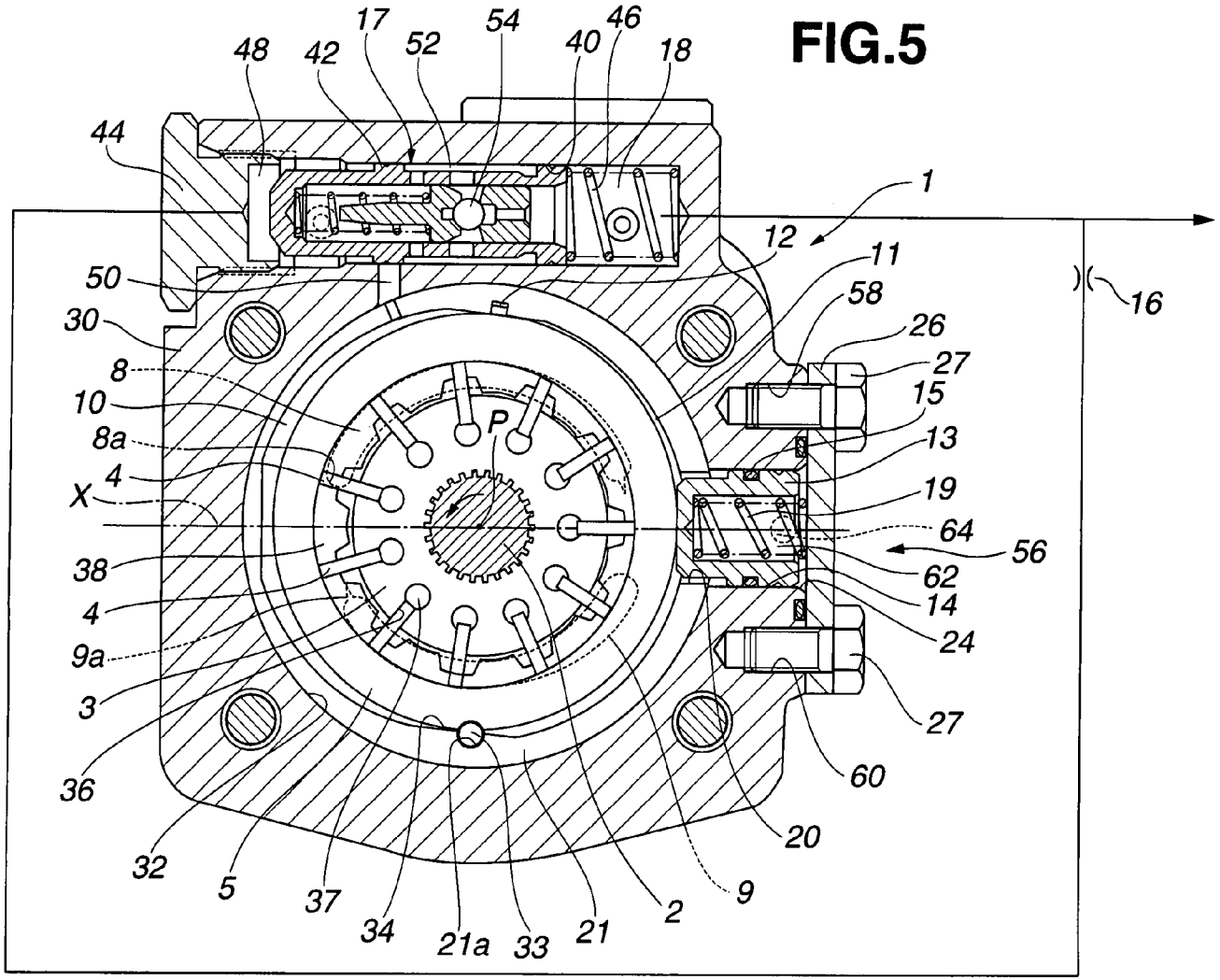
FIG. 5 is an explanatory diagram showing an operation of the first embodiment of the variable displacement vane pump according to the present invention.

When the vane pump is operated at high rotational speed not less than a predetermined rotational speed, the high fluid pressure is introduced into first fluid pressure chamber 10 via high-pressure chamber 48 of control valve 17. In this condition, cam ring 5 is urged by the high-pressure fluid in first fluid pressure chamber 10 against the biasing force of plunger 13 to thereby be swung around the swing fulcrum on support surface 34 toward the side of second fluid pressure chamber 11 as shown in FIG. 5. The eccentric amount of cam ring 5 with respect to rotor 3 becomes smaller, so that the discharge flow rate of the vane pump is reduced to a required value. As a result, an optimal discharge characteristic of the vane pump can be obtained.

The variable displacement vane pump of the first embodiment as described above can perform the following effects. First, with the arrangement of cam ring biasing mechanism 56, cam ring 5 can be always biased by plunger 13 of cam ring biasing mechanism 56 toward the side of first fluid pressure chamber 10 to thereby restrain an adverse swing motion of cam ring 5 from the side of first fluid pressure chamber 10 toward the side of second fluid pressure chamber 11. Therefore, it is possible to suppress undesired decrease of the eccentric amount of cam ring 5 with respect to rotor 3 and undesired reduction of the discharge flow rate of the vane pump.

Specifically, in the low-pressure type variable displacement vane pump of the first embodiment, the low fluid pressure on the suction side is always introduced into second fluid pressure chamber 11. Therefore, it is difficult to produce a force large enough to bias cam ring 5 in the direction in which the eccentric amount of cam ring 5 with respect to rotor 3 is increased. Further, support surface 34 of adapter ring 21 is inclined so as to facilitate the swing motion of cam ring 5 toward the side of second fluid pressure chamber 11, whereby the tendency of cam ring 5 to incline toward the side of second fluid pressure chamber 11 is enhanced. Hence, in order to produce the force large enough to bias cam ring 5 in the eccentric amount increasing direction, plunger 13 of the first embodiment is urged toward the side of first fluid pressure chamber 10 using the spring force of coil spring 19 and the high fluid pressure which is introduced from discharge port 9 into pressure receiving chamber 62. As a result, cam ring 5 can be prevented from being adversely swung toward the side of second fluid pressure chamber 11 to thereby suppress undesired decrease in the eccentric amount of cam ring 5 with respect to rotor 3.

Further, with the provision of seal 15 on the outer circumferential surface of plunger 13, the high fluid pressure introduced from discharge port 9 into pressure receiving chamber 62 can be effectively prevented from leaking out of pressure receiving chamber 62. This ensures the projecting motion of plunger 13 toward cam ring 5.

Further, even when pressure receiving chamber 62 of cam ring biasing mechanism 56 is supplied with the low fluid pressure which is discharged immediately after the vane pump start, the projecting motion of plunger 13 can be effectively achieved by the spring force of coil spring 19 to thereby prevent cam ring 5 from being adversely swung toward the side of second fluid pressure chamber 11. On the other hand, under condition of the high rotational speed operation of the vane pump, pressure receiving chamber 62 can be supplied with the high fluid pressure of the working fluid discharged. This compensates for lack of the biasing force of plunger 13 which is caused due to a pressure-receiving surface area of end surface 23*c* of plunger 13 which is smaller than a pressure-receiving surface area of first fluid pressure chamber 10. As a result, an adverse swing motion of cam ring 5 toward the side of second fluid pressure chamber 11 can be suppressed.

Further, plunger 13 is made of the aluminum alloy having the same value of coefficient of linear expansion as that of front body 30. Plunger 13, therefore, can be smoothly moved in plunger accommodating bore 14 without backlash or slide resistance even when thermal change occurs during the vane pump operation. Further, since end portion 23 of plunger 13 has outer diameter D1 slightly smaller than outer diameter D of body portion 22 of plunger 13, the diameter of small-diameter plunger accommodating bore 20 of adapter ring 21 can be reduced to thereby prevent deterioration of rigidity of adapter ring 21. Further, step 23*a* of plunger 13 can restrict the projecting motion of plunger 13 and prevent plunger 13 from being excessively projected from small-diameter plunger accommodating bore 20.

Upon assembling plunger 13 to pump body 1, plunger 13 is inserted into large-diameter plunger accommodating bore 14 and small-diameter plunger accommodating bore 20, and coil spring 19 is installed to the cylindrical bore of plunger 13. Then, lid 26 is fixed to front body 30 by means of bolts 27, 27. Thus, the assembling work of plunger 13 can be easily performed. Further, each of bolts 27 is arranged on an imaginary plane substantially perpendicular to driving shaft 2 without largely projecting from the side wall of front body 30. This serves for downsizing pump body 1.

Further, control valve 17 is configured to selectively supply the low fluid pressure and the high fluid pressure to first fluid pressure chamber 10. With the provision of control valve 17, the swing position of cam ring 5, i.e., the eccentric amount of cam ring 5 with respect to rotor 3, can be controlled with high accuracy.

Figure 6:
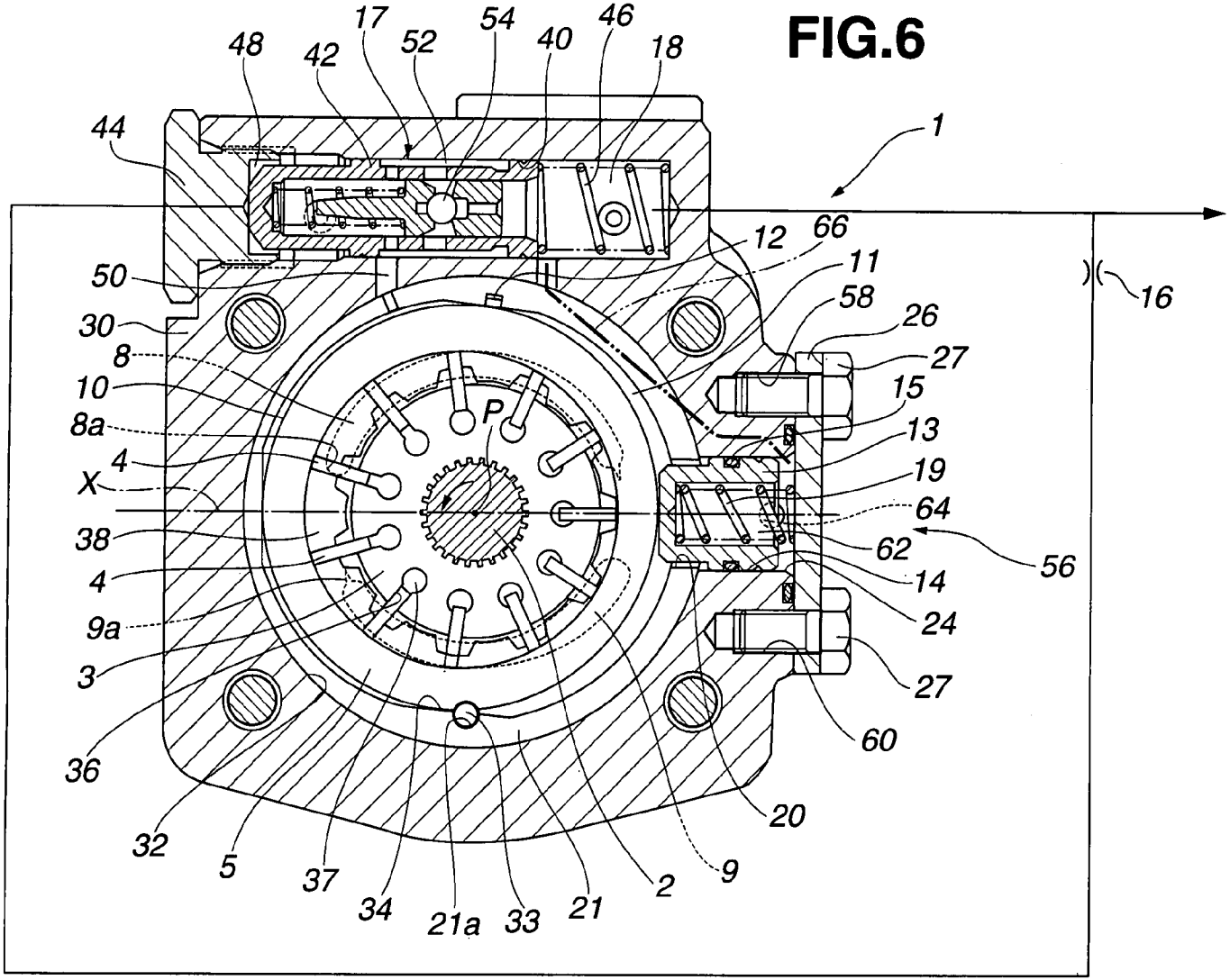
FIG. 6 is a view similar to FIG. 1, showing a second embodiment of the variable displacement vane pump.

Referring to FIG. 6, there is shown a second embodiment of the variable displacement vane pump which differs from the first embodiment in provision of pressure introduction passage 66 through which downstream pressure chamber 18 of control valve 17 and pressure receiving chamber 62 of cam ring biasing mechanism 56 are communicated with each other. Like reference numerals denote like parts, and therefore, detailed descriptions therefor are omitted. As illustrated in FIG. 6, pressure introduction passage 66 is formed in pump body 1 as indicated by broken line. In the second embodiment, the fluid pressure from discharge port 9 is not introduced into pressure receiving chamber 62, and the fluid pressure in downstream pressure chamber 18 of control valve 17 is introduced into pressure receiving chamber 62 through pressure introduction passage 66. That is, the pressure fluid on a downstream side of metering orifice 16 is supplied to pressure receiving chamber 62 through pressure introduction passage 66.

With the provision of pressure introduction passage 66, plunger 13 of cam ring biasing mechanism 56 is urged toward cam ring 5 by the fluid pressure downstream of metering orifice 16 in addition to the spring force of coil spring 19. Owing to the sufficiently large urging force exerted on plunger 13, plunger 13 can be surely prevented from being adversely swung toward the side of second fluid pressure chamber 11.

Figure 7:
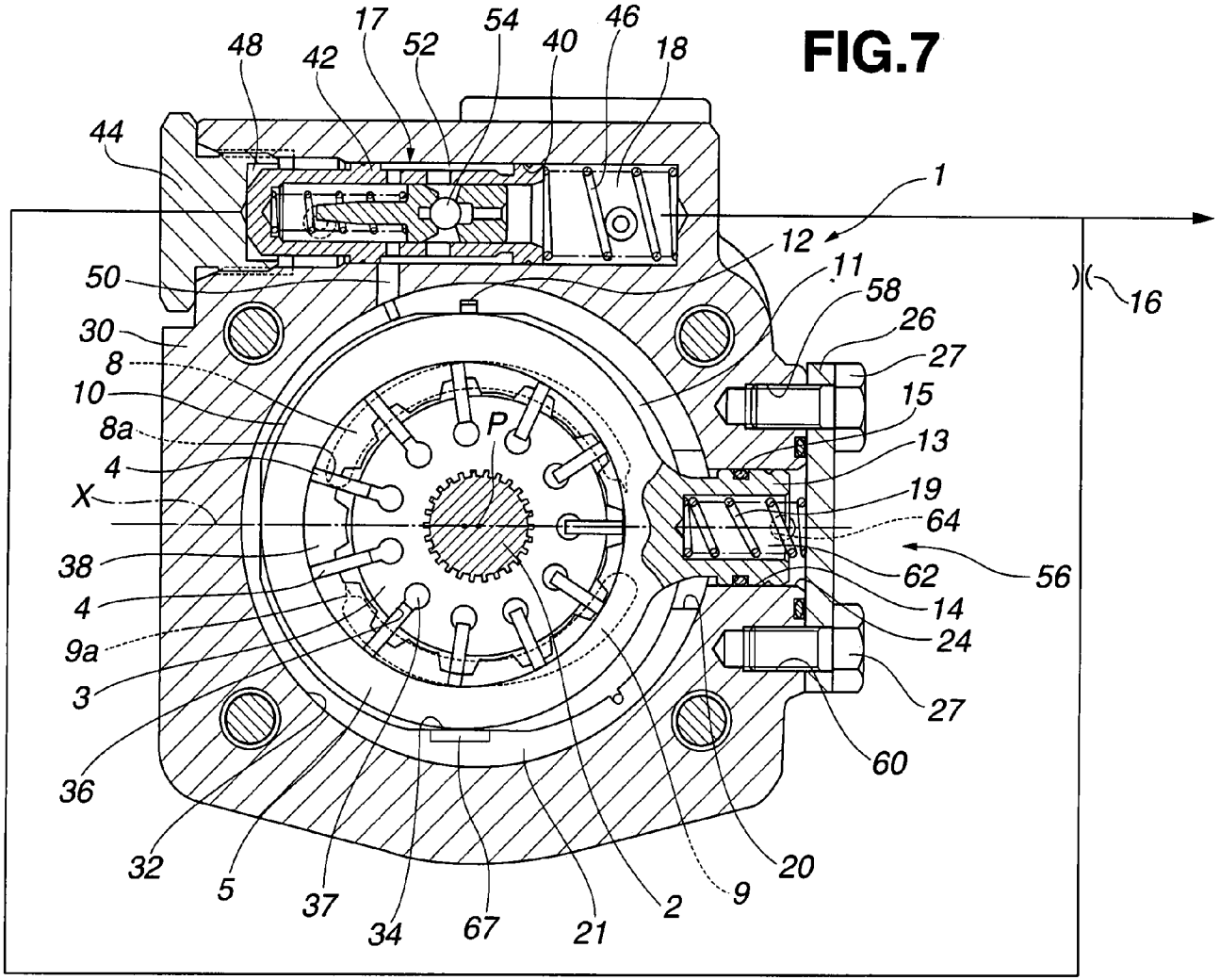
FIG. 7 is a view similar to FIG. 1, showing a third embodiment of the variable displacement vane pump according to the present invention.

Referring to FIG. 7, there is shown a third embodiment of the variable displacement vane pump which differs from the first embodiment in that plunger 13 of cam ring biasing mechanism 56 is integrally formed with cam ring 5 and support plate 67 for cam ring 5 is provided. As illustrated in FIG. 7, cam ring 5 is formed with a cylindrical projection which radially outwardly projects from the outer circumferential surface of cam ring 5. The projection serves as plunger 13. Further, support plate 67 having a planar surface is provided on a lower portion of an inner circumferential surface of adapter ring 21. Support plate 67 is configured to support cam ring 5 so as to be moveable on the planar surface in a substantially horizontal direction. Similar to the first embodiment, coil spring 19 is accommodated within pressure receiving chamber 62 of cam ring biasing mechanism 56. The high-pressure fluid from discharge port 9 is introduced into pressure receiving chamber 62 through pressure introduction passage 64.

In this embodiment, even when cam ring 5 starts to horizontally move on support plate 67 toward the side of second fluid pressure chamber 11 during the pump rotation, plunger 13 can bias cam ring 5 to be restrained from the adverse movement toward the side of second fluid pressure chamber 11 owing to the spring force of coil spring 19 and the high fluid pressure in pressure receiving chamber 62. Accordingly, this embodiment can attain the same effect as that of the first embodiment. Further, the number of parts of the vane pump can be reduced, serving for simplifying the construction and reducing the production cost.

Figure 8:
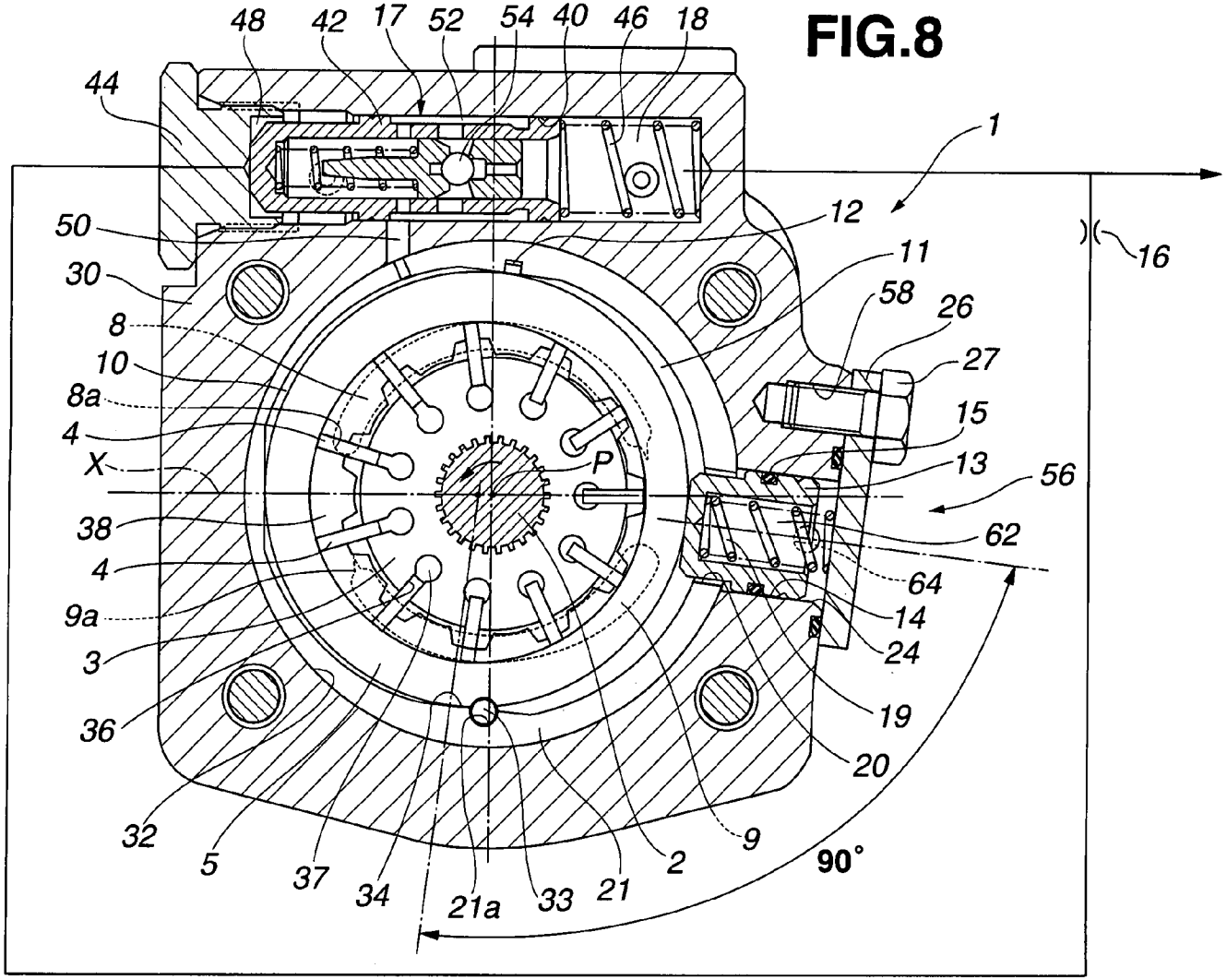
FIG. 8 is a view similar to FIG. 1, showing a fourth embodiment of the variable displacement vane pump according to the present invention.

Referring to FIG. 8, there is shown a fourth embodiment of the variable displacement vane pump which differs from the first embodiment in arrangement of cam ring biasing mechanism 56. As illustrated in FIG. 8, cam ring biasing mechanism 56 is arranged such that plunger 13 is inclined toward a side of suction port 8 with respect to imaginary reference plane X which extends through a middle point between terminal end 8*a* of suction port 8 and start end 9*a* of discharge port 9 and a middle point between a start end of suction port 8 and a terminal end of discharge port 9. Specifically, cam ring biasing mechanism 56 is arranged such that plunger 13 is placed offset around driving shaft 2 by an approximate 90° angle from the swing fulcrum of cam ring 5 toward the side of second fluid pressure chamber 11, namely, in a counterclockwise direction when viewed in FIG. 8. In other words, cam ring biasing mechanism 56 is located in a position on the side of second fluid pressure chamber 11 in which an angle between a line through the swing fulcrum of cam ring 5 and a central axis of cam ring 5, and a line through a central axis of plunger 13 is an approximate 90°. Plunger 13, therefore, biases cam ring 5 toward driving shaft 2 not in the horizontal direction but in a downwardly slanting direction.

In this embodiment, when cam ring 5 starts to be adversely swung around the swing fulcrum on support surface 34 toward the side of second fluid pressure chamber 11, cam ring 5 is biased by plunger 13 toward driving shaft 2 in a direction perpendicular to the central axis of cam ring 5. This effectively prevents the adverse swing motion of cam ring 5. Further, the direction of the projecting and retreating motion of plunger 13 relative to the united plunger accommodating bore can be substantially aligned with the direction of the swing motion of cam ring 5. The swing force of cam ring 5, therefore, acts on plunger 13 in the axial direction of plunger 13 without diverting in a radial direction of plunger 13. As a result, plunger 13 can be smoothly moved in the axial direction without being adversely influenced by the swing force of cam ring 5.

Figure 9:
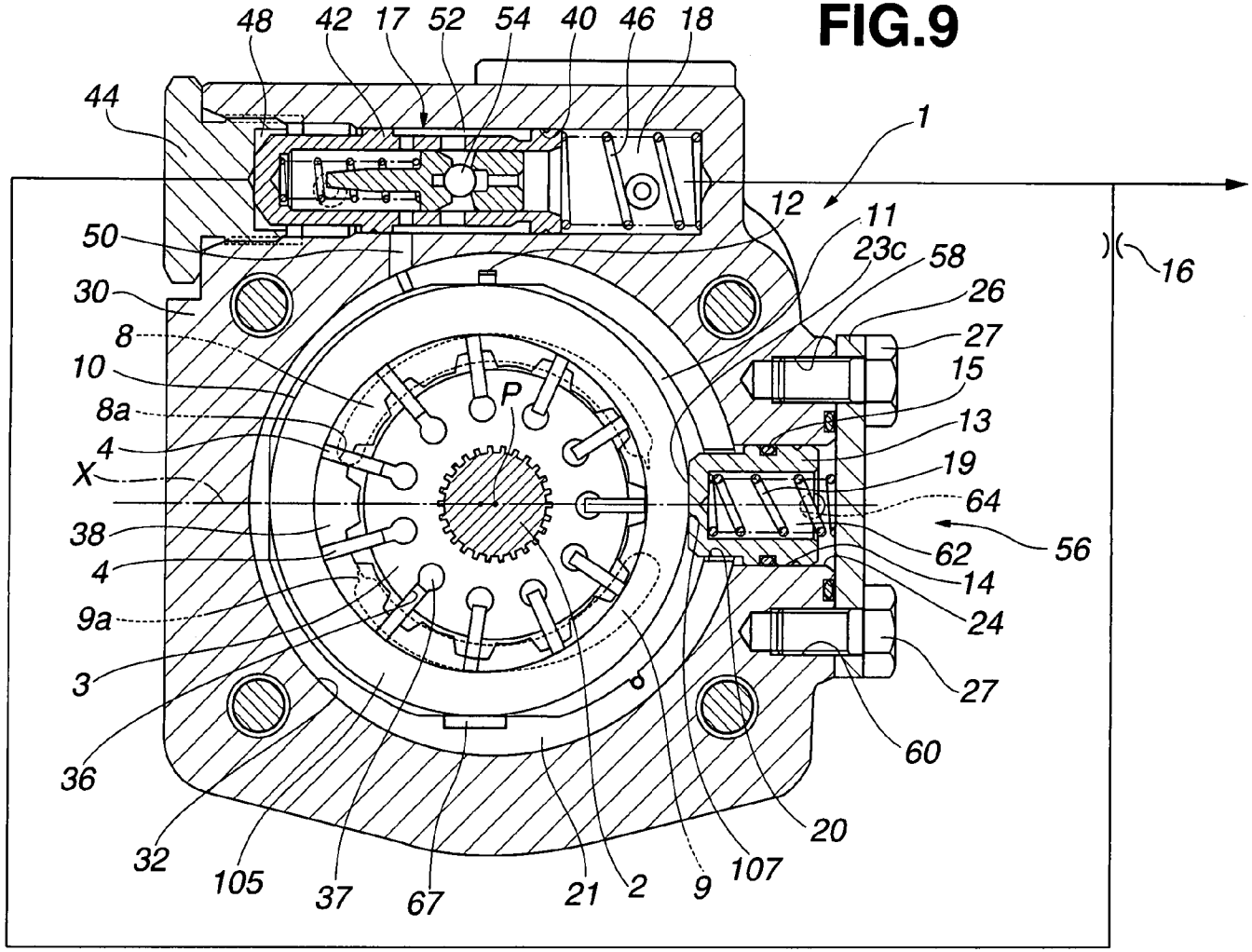
FIG. 9 is a view similar to FIG. 1, showing a fifth embodiment of the variable displacement vane pump according to the present invention.

Referring to FIG. 9, there is shown a fifth embodiment of the variable displacement vane pump which differs from the first embodiment in provision of support plate 67 on adapter ring 21 and construction of cam ring 105. As illustrated in FIG. 9, support plate 67 having a planar surface is provided on a lower portion of the inner circumferential surface of adapter ring 21. Support plate 67 is configured to support cam ring 105 so as to be moveable on the planar surface in a substantially horizontal direction. Cam ring 105 has planar contact surface 107 on the outer circumferential surface which is contacted with planar end surface 23*c* of plunger 13.

In this embodiment, planar end surface 23*c* of plunger 13 and planar contact surface 107 of cam ring 105 can be in surface-to-surface contact with each other to thereby ensure the contact condition between plunger 13 and cam ring 105. This serves for preventing cam ring 105 from being adversely moved toward the side of second fluid pressure chamber 11 in the substantially horizontal direction.

Figure 10:
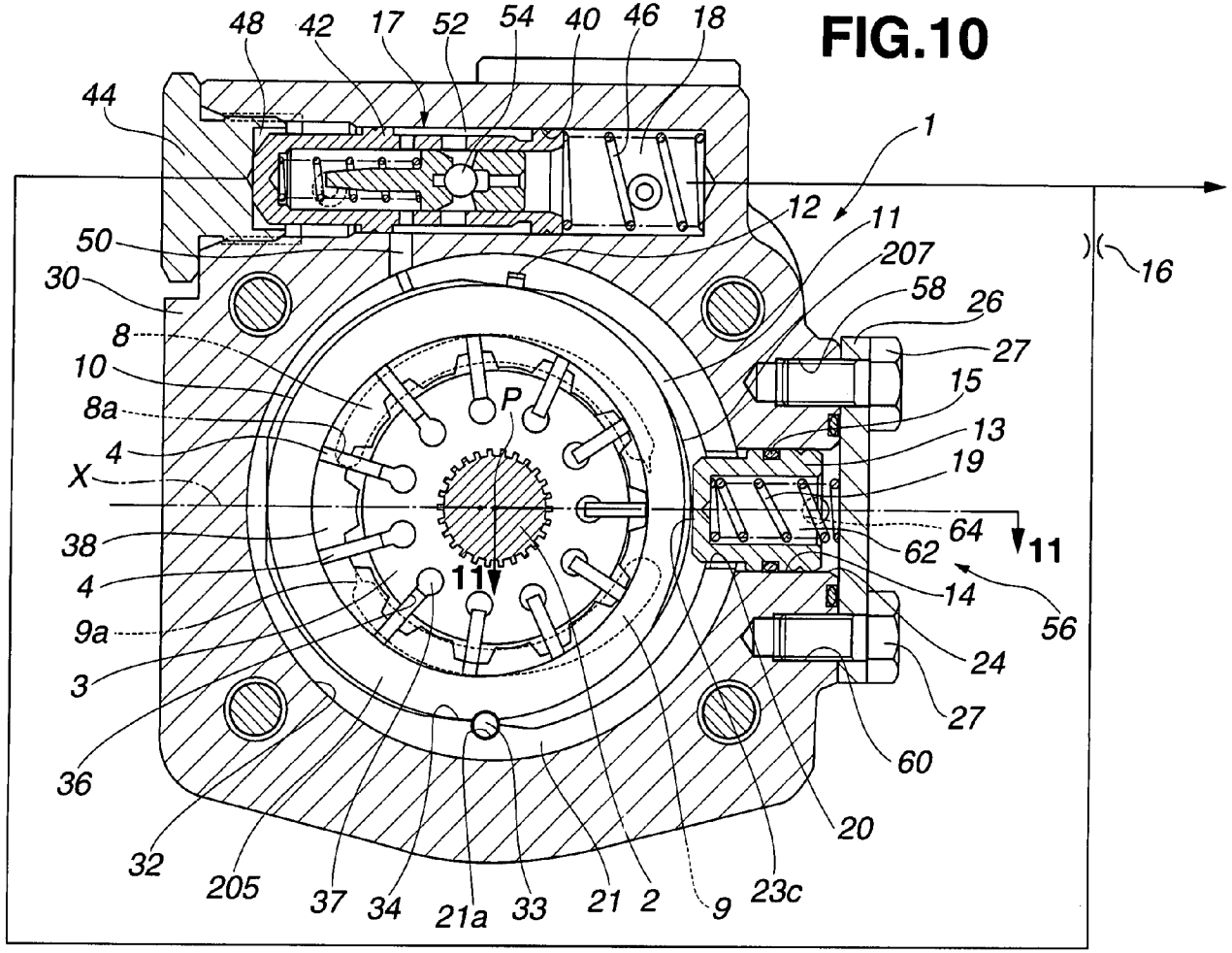
FIG. 10 is a view similar to FIG. 1, showing a sixth embodiment of the variable displacement vane pump according to the present invention.
Figure 11:
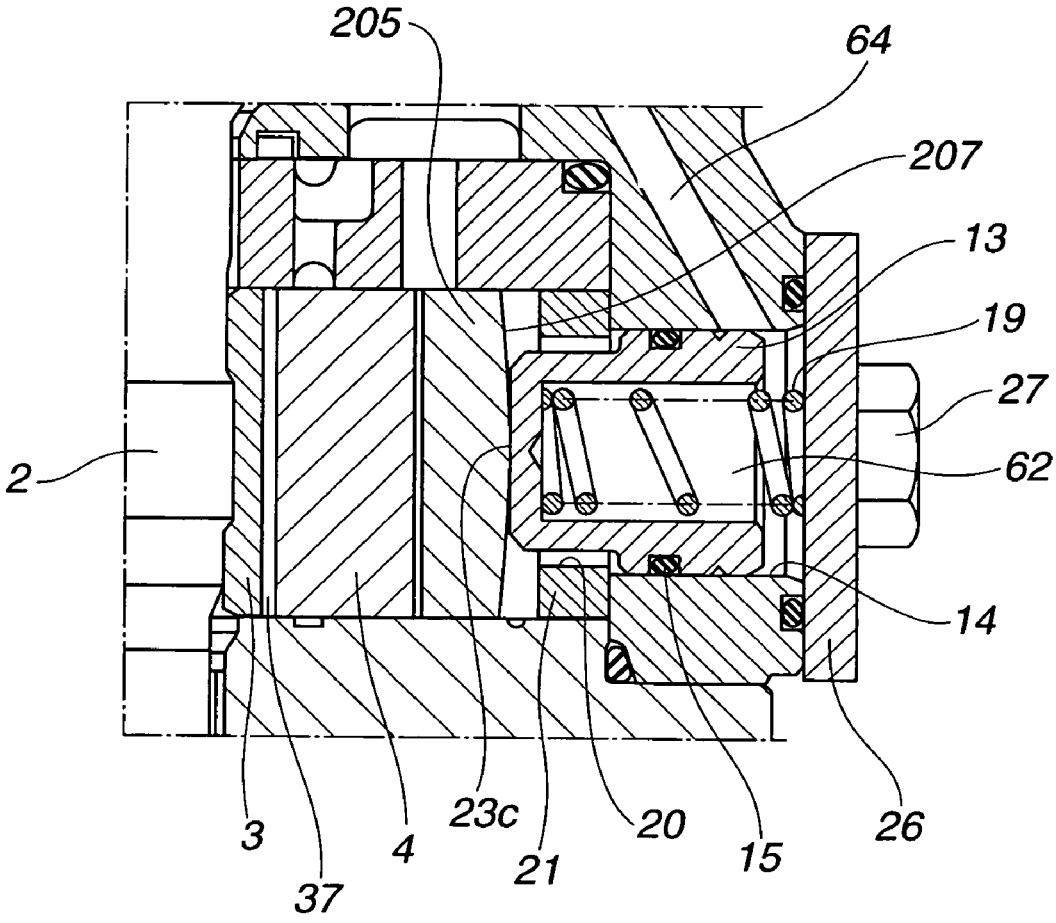
FIG. 11 is a section taken along line 11-11 of FIG. 10.

Referring to FIGS. 10 and 11, there is shown a sixth embodiment of the variable displacement vane pump which differs from the first embodiment in construction of cam ring 205. As illustrated in FIGS. 10 and 11, cam ring 205 includes convex contact portion 207 on the outer circumferential surface which is contacted with planar end surface 23*c* of plunger 13. Convex contact portion 207 is formed into a partially spherical shape.

In this embodiment, convex contact surface 207 of cam ring 205 and end surface 23*c* of plunger 13 are in point contact with each other. A smooth slide contact between convex contact surface 207 of cam ring 205 and end surface 23*c* of plunger 13 can be always established, so that plunger 13 can follow the swing motion of cam ring 205 during the swing motion of cam ring 205.

Referring back to FIG. 4, there is shown modification of plunger 13. As illustrated in FIG. 4, plunger 13 has convex end surface 123 which is formed into a partially spherical shape as indicated by broken line. Convex end surface 123 of plunger 13 may be contacted with the outer circumferential surface of cam ring 5 of the first embodiment. In this modification, the same effect as that of the sixth embodiment can be obtained.

Further, as illustrated in FIG. 4, plunger 13 can be modified such that body portion 22 has convex outer circumferential surface 222 as indicated by broken line. Convex outer circumferential surface 222 of body portion 22 of plunger 13 is formed into a partially spherical shape. Plunger 13, therefore, can be inclined relative to the inner circumferential surface of large-diameter plunger accommodating bore 14 while keeping in contact therewith. Plunger 13 is allowed to follow the swing motion of cam ring 5, so that end surface 23*c* of plunger 13 can be kept in contact with the outer circumferential surface of cam ring 5. This serves for always placing plunger 13 in an appropriate position relative to cam ring 5 in which plunger 13 can appropriately urge cam ring 5.

Figure 12:
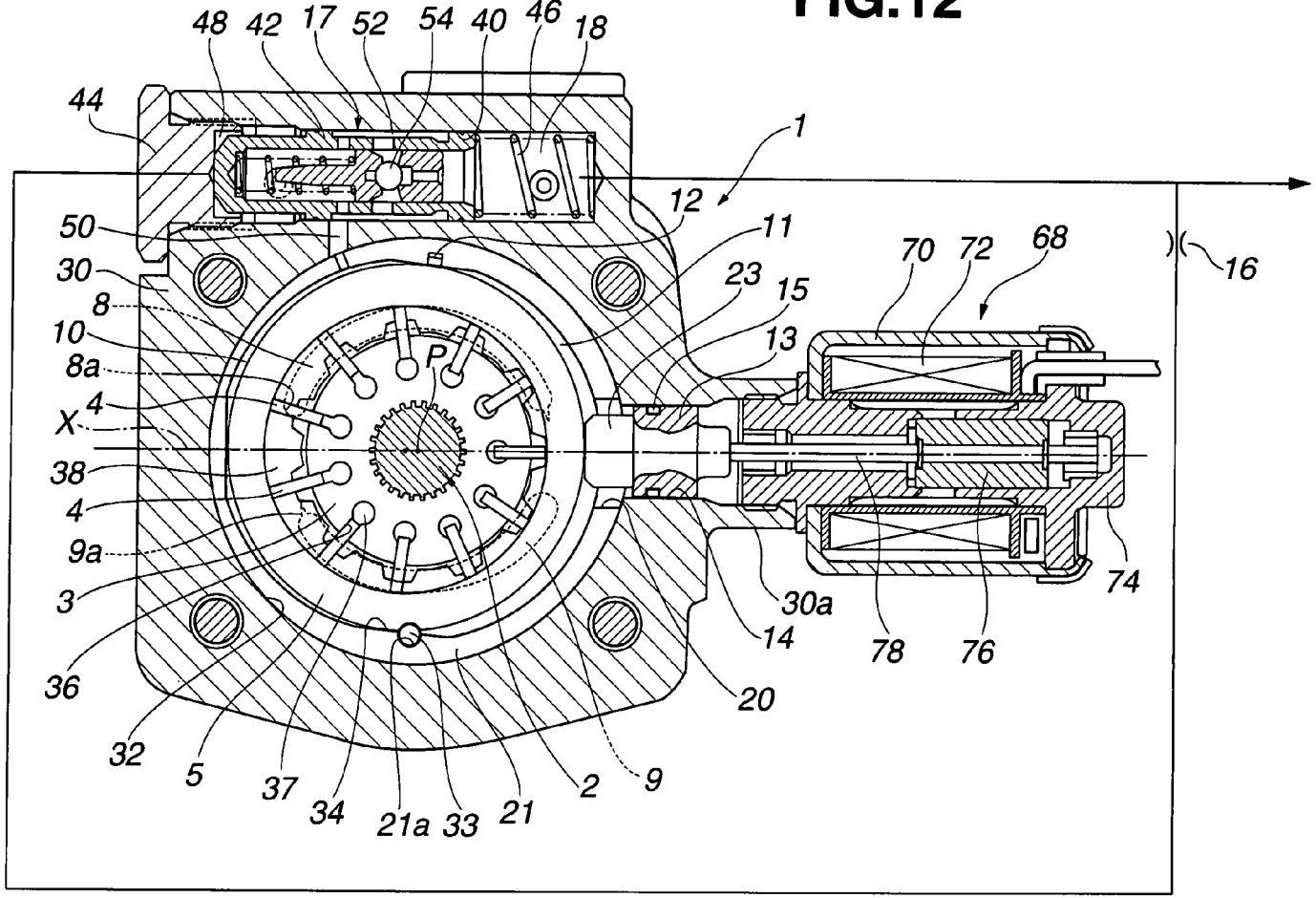
FIG. 12 is a view similar to FIG. 1, showing an essential part of a seventh embodiment of the variable displacement vane pump according to the present invention.

Referring to FIG. 12, there is shown a seventh embodiment of the variable displacement vane pump which differs from the first embodiment in that solenoid-controlled cam ring biasing mechanism 68 is used. As illustrated in FIG. 12, cam ring biasing mechanism 68 includes solenoid 70, cylindrical electromagnetic coil 72 disposed within solenoid 70, stationary core 74 fixed to electromagnetic coil 72, moveable core 76 slidably disposed in stationary core 74, and push rod 78 fixed to moveable core 76. Solenoid 70 is mounted to cylindrical projection 30*a* of front body 30 of pump body 1 which outwardly projects from the side wall of front body 30 and is integrally formed with front body 30. Electromagnetic coil 72 is connected to an electronic controller, not shown, and receives a control command from the controller. Stationary core 74 is fixedly disposed on a side of one axial end of electromagnetic coil 72 and partly fitted into electromagnetic coil 72. Moveable core 76 is slidably moved in stationary core 74 upon energizing electromagnetic coil 72. Push rod 78 has one axial end which is fixed to an inner circumferential periphery of moveable core 76 and an opposite axial end which is contacted with a rear end portion of solid plunger 13. The controller is configured to develop a control command on the basis of output signals indicative of an operating condition of the vane pump which are transmitted from sensors, for instance, a rotation sensor sensing a rotation number of driving shaft 2, and transmit the control command to electromagnetic coil 72.

When electromagnetic coil 72 is energized to excite stationary core 74 in response to the control command which is transmitted from the controller on the basis of the pump operating condition, moveable core 76 is moved to axially urge plunger 13 through push rod 78 depending on the exciting force of stationary core 74. The urging force which acts on plunger 13 can be varied by changing the exciting force of stationary core 74. Accordingly, the urging force acting on plunger 13, namely, a biasing force of plunger 13 which is exerted on cam ring 5 can be varied depending on change in the pump rotation number. In this embodiment, an adverse swing motion of cam ring 5 can be suppressed with higher accuracy.

Figure 13:
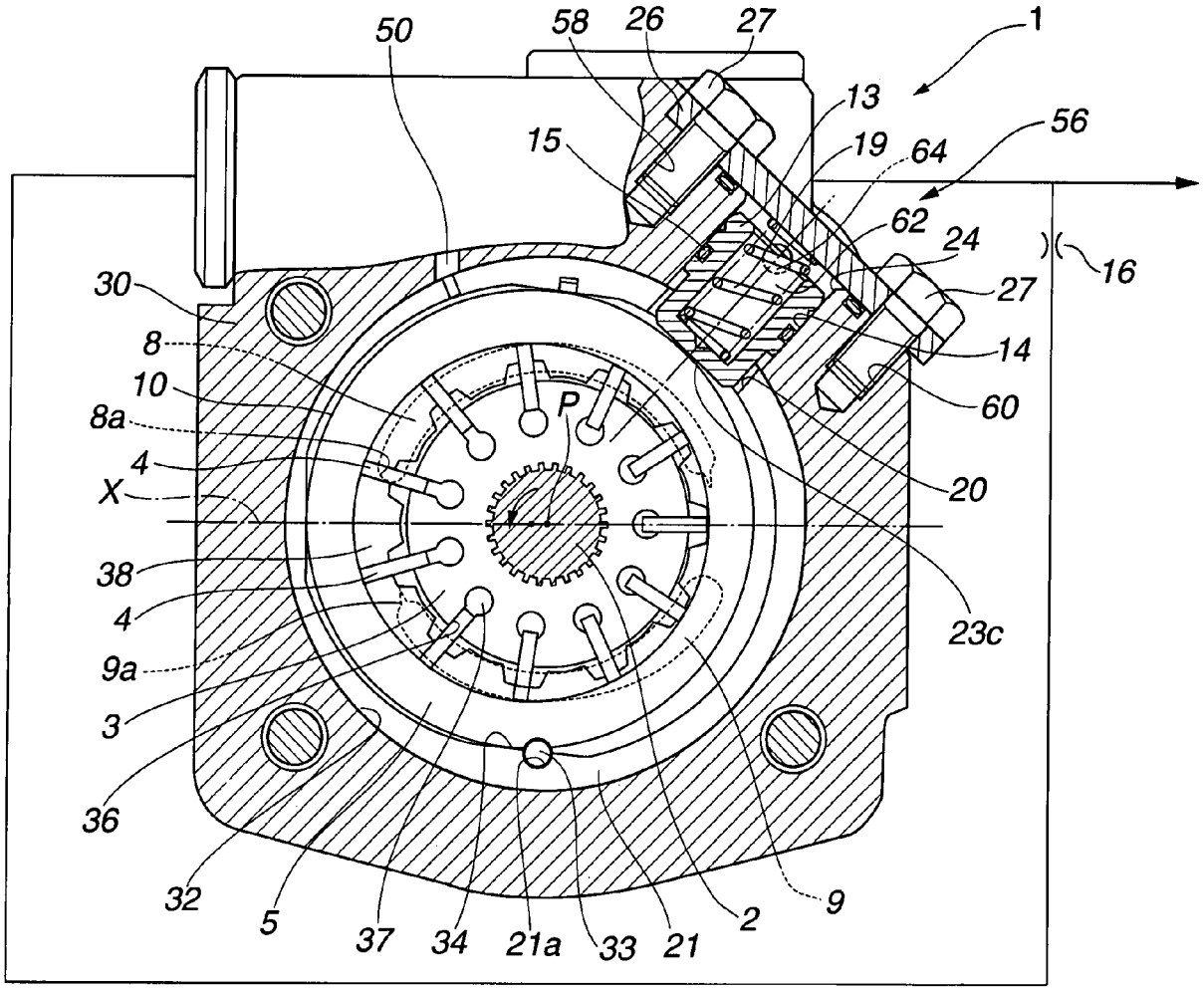
FIG. 13 is a fragmentary cross-section showing a modified arrangement of a cam ring biasing mechanism of the first embodiment of the variable displacement vane pump.

Referring to FIG. 13, there is shown an eighth embodiment of the variable displacement vane pump which differs from the first embodiment in arrangement of cam ring biasing mechanism 56. As illustrated in FIG. 13, cam ring biasing mechanism 56 is arranged such that plunger 13 is located on an opposite side of the swing fulcrum of cam ring 5 with respect to driving shaft 2 and on the side of second fluid pressure chamber 11. With this arrangement, a distance between the swing fulcrum of cam ring 5 and a contact point of plunger 13 at which end surface 23*c* of plunger 13 is in contact with the outer circumferential surface of cam ring 5 can be increased to thereby provide an enhanced leverage for rotation of cam ring 5. This results in reducing the biasing force to be exerted on plunger 13.

The construction of the variable displacement vane pump of the present invention is not limited to the above-described embodiments. A fluid pressure on an upstream side of metering orifice 16 which is introduced into high-pressure chamber 48 of control valve 17 may be introduced into pressure receiving chamber 62 of cam ring biasing mechanism 56. Further, same fluid pressure as the fluid pressure to be introduced into first fluid pressure chamber 10 via control valve 17 may be introduced into pressure receiving chamber 62 of cam ring biasing mechanism 56. In this case, the fluid pressure which acts on plunger 13 can be varied corresponding to rise in the fluid pressure which is introduced into first fluid pressure chamber 10. Accordingly, when the fluid pressure in first fluid pressure chamber 10 is low, the fluid pressure acting on plunger 13 becomes low so that the swing motion of cam ring 5 can be ensured without being disturbed. In contrast, when the fluid pressure in first fluid pressure chamber 10 is high, the fluid pressure acting on plunger 13 becomes high so that cam ring 5 can be prevented from being adversely swung toward the side of second fluid pressure chamber 11.

This application is based on a prior Japanese Patent Application No. 2005-371332 filed on Dec. 26, 2005. The entire contents of the Japanese Patent Application No. 2005-371332 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable displacement vane pump, comprising:

a pump body;

a driving shaft supported on the pump body;

a rotor disposed within the pump body and rotatably driven by the driving shaft, the rotor including a plurality of vanes arranged in a circumferential direction of the rotor;

an annular cam ring disposed within the pump body so as to be swingable around a swing fulcrum, the cam ring cooperating with the rotor and the vanes to define a plurality of pump chambers on an inner circumferential side of the cam ring;

a first support member disposed at one axial end of the cam ring;

a second support member disposed at an opposite axial end of the cam ring;

a suction port and a discharge port which are disposed on at least one of the first and second support members, the suction port being open to a suction area in which a volume of each of the pump chambers is gradually increased with the rotation of the rotor, the discharge port being open to a discharge area in which the volume of each of the pump chambers is gradually decreased with the rotation of the rotor;

a seal disposed on an outer circumferential side of the cam ring so as to divide a space on the outer circumferential side of the cam ring into a first fluid pressure chamber and a second fluid pressure chamber, the first fluid pressure chamber being defined in a swing direction of the cam ring in which the cam ring is swung to cause increase in a flow rate of a working fluid which is discharged from the discharge port, the second fluid pressure chamber being defined in a swing direction of the cam ring in which the cam ring is swung to cause decrease in the flow rate of the working fluid which is discharged from the discharge port, the second fluid pressure chamber receiving a suction pressure; and a plunger which biases the cam ring from a side of the second fluid pressure chamber toward a side of the first fluid pressure chamber.

2. The variable displacement vane pump as claimed in claim 1, wherein the plunger is constructed such that a fluid pressure discharged from the discharge port is introduced into an inside of the plunger.

3. The variable displacement vane pump as claimed in claim 2, wherein the pump body comprises a plunger accommodating bore in which the plunger is disposed so as to be moveable in an axial direction of the plunger accommodating bore, the variable displacement vane pump further comprising a seal disposed between an outer circumferential surface of the plunger and an inner circumferential surface of the plunger accommodating bore.

4. The variable displacement vane pump as claimed in claim 2, further comprising a metering orifice disposed on a downstream side of the discharge port, wherein a fluid pressure on a downstream side of the metering orifice is introduced into the plunger.

5. The variable displacement vane pump as claimed in claim 2, further comprising a metering orifice disposed on a downstream side of the discharge port, wherein a fluid pressure on an upstream side of the metering orifice is introduced into the plunger.

6. The variable displacement vane pump as claimed in claim 2, further comprising a metering orifice disposed on a downstream side of the discharge port and a control valve which is operated by a pressure difference between upstream and downstream sides of the metering orifice, the control valve controlling at least a fluid pressure to be introduced in the first fluid pressure chamber, wherein the plunger receives a fluid pressure on the downstream side of the metering orifice which is introduced into the control valve.

7. The variable displacement vane pump as claimed in claim 6, wherein the control valve comprises a downstream pressure chamber into which the fluid pressure on the downstream side of the metering orifice is introduced, the downstream pressure chamber being disposed on a side of one end of the control valve and located on a same side of the plunger with respect to the driving shaft, the variable displacement vane pump further comprising a pressure introduction passage through which the downstream pressure chamber of the control valve and the inside of the plunger are communicated with each other.

8. The variable displacement vane pump as claimed in claim 2, further comprising a metering orifice disposed on a downstream side of the discharge port and a control valve which is operated by a pressure difference between upstream and downstream sides of the metering orifice, the control valve being constructed to control at least a fluid pressure to be introduced in the first fluid pressure chamber, wherein the plunger receives a fluid pressure on the upstream side of the metering orifice which is introduced into the control valve.

9. The variable displacement vane pump as claimed in claim 8, wherein the control valve is constructed to control the fluid pressure to be introduced in the first fluid pressure chamber by selectively supplying the fluid pressure on the upstream side of the metering orifice and a fluid pressure which is introduced from the suction port into the control valve, and the plunger receives a same fluid pressure as the fluid pressure to be introduced in the first fluid pressure chamber.

10. The variable displacement vane pump as claimed in claim 2, further comprising a resilient member which urges the plunger toward the cam ring.

11. The variable displacement vane pump as claimed in claim 2, wherein the fluid pressure which is introduced into the inside of the plunger is higher than a fluid pressure to be introduced into the first fluid pressure chamber.

12. The variable displacement vane pump as claimed in claim 1, wherein the cam ring has a planar contact surface which is contacted with the plunger.

13. The variable displacement vane pump as claimed in claim 1, further comprising a solenoid which is operative to bias the plunger toward the cam ring.

14. The variable displacement vane pump as claimed in claim 1, wherein the plunger has a convex end surface which is contacted with the cam ring and formed into a partially spherical shape.

15. The variable displacement vane pump as claimed in claim 1, wherein the plunger is disposed on an opposite side of the swing fulcrum of the cam ring with respect to the driving shaft.

16. The variable displacement vane pump as claimed in claim 1, wherein the plunger is arranged to be inclined toward a side of the suction port with respect to an imaginary reference plane which extends through a middle point between a start end of the suction port and a terminal end of the discharge port and a middle point between a terminal end of the suction port and a start end of the discharge port.

17. The variable displacement vane pump as claimed in claim 1, wherein the pump body comprises a plunger accommodating bore in which the plunger is disposed so as to be moveable in an axial direction of the plunger accommodating bore, the pump body and the plunger are made of a material which has a same value of coefficient of linear expansion.

18. The variable displacement vane pump as claimed in claim 1, wherein the pump body comprises a plunger accommodating bore in which the plunger is disposed so as to be moveable in an axial direction of the plunger accommodating bore, the plunger has a generally cylindrical shape and a convex outer circumferential surface which is formed into a partially spherical shape.

19. The variable displacement vane pump as claimed in claim 1, wherein the plunger is placed offset around the driving shaft by an approximate 90° angle from the swing fulcrum of the cam ring toward the side of the second fluid pressure chamber.

20. The variable displacement vane pump as claimed in claim 1, wherein the cam ring comprises a convex contact portion on an outer circumferential surface which is contacted with the plunger, the convex contact portion being formed into a partially spherical shape.

21. The variable displacement vane pump as claimed in claim 1, further comprising an annular adapter ring disposed within the pump body, the cam ring being swingably disposed inside the adapter ring, the adapter ring cooperating with the cam ring to define therebetween the first fluid pressure chamber and the second fluid pressure chamber, wherein the pump body comprises a first plunger accommodating bore, the adapter ring comprises a second plunger accommodating bore, and the plunger comprises a body portion slidably disposed in the first plunger accommodating bore and a small-diameter portion which has a diameter smaller than a diameter of the body portion and extends toward the cam ring through the second plunger accommodating bore.

22. The variable displacement vane pump as claimed in claim 21, wherein the plunger further comprises a stop between the body portion and the small-diameter portion, the stop is configured to abut on a stepped surface between an inner circumferential surface of the first plunger accommodating bore and an inner circumferential surface of the second plunger accommodating bore.

23. The variable displacement vane pump as claimed in claim 1, further comprising a lid and a bolt through which the lid is fixed to the pump body, wherein the pump body comprises a plunger accommodating bore with an open end which is exposed to an outside of the pump body, the plunger is disposed in the plunger accommodating bore so as to be moveable in an axial direction of the plunger accommodating bore, and the open end of the plunger accommodating bore is covered with the lid.

24. The variable displacement vane pump as claimed in claim 23, wherein the bolt comprises a plurality of bolts which are arranged along an imaginary plane substantially perpendicular to the driving shaft.

25. The variable displacement vane pump as claimed in claim 1, further comprising a metering orifice disposed on a downstream side of the discharge port and a control valve which is operated by a pressure difference between upstream and downstream sides of the metering orifice, the control valve controlling a fluid pressure to be introduced in the first fluid pressure chamber.

26. The variable displacement vane pump as claimed in claim 1, wherein the cam ring is supported on a support surface which is inclined toward the side of the second fluid pressure chamber with respect to an imaginary reference plane which extends through a rotation axis of the driving shaft and a middle point between a terminal end of the suction port and a start end of the discharge port such that a distance between the support surface and the imaginary reference plane is gradually increased.

27. A variable displacement vane pump, comprising:

a pump body;

a driving shaft supported on the pump body;

a rotor disposed within the pump body and rotatably driven by the driving shaft, the rotor including a plurality of vanes arranged in a circumferential direction of the rotor;

an annular cam ring disposed within the pump body so as to be swingable around a swing fulcrum, the cam ring cooperating with the rotor and the vanes to define a plurality of pump chambers on an inner circumferential side of the cam ring;

a first support member disposed at one axial end of the cam ring;

a second support member disposed at an opposite axial end of the cam ring;

a suction port and a discharge port which are disposed on at least one of the first and second support members, the suction port being open to a suction area in which a volume of each of the pump chambers is gradually increased with the rotation of the rotor, the discharge port being open to a discharge area in which the volume of each of the pump chambers is gradually decreased with the rotation of the rotor;

a seal disposed on an outer circumferential side of the cam ring so as to divide a space on the outer circumferential side of the cam ring into a first fluid pressure chamber and a second fluid pressure chamber, the first fluid pressure chamber being defined in a swing direction of the cam ring in which the cam ring is swung to cause increase in a flow rate of a working fluid which is discharged from the discharge port, the second fluid pressure chamber being defined in a swing direction of the cam ring in which the cam ring is swung to cause decrease in the flow rate of the working fluid which is discharged from the discharge port, the second fluid pressure chamber receiving a suction pressure;

a metering orifice disposed on a downstream side of the discharge port;

a control valve which receives a pressure difference between upstream and downstream sides of the metering orifice; and a plunger which receives a fluid pressure controlled by the control valve and biases the cam ring from a side of the second fluid pressure chamber toward a side of the first fluid pressure chamber.

28. The variable displacement vane pump as claimed in claim 27, wherein the control valve controls a fluid pressure in the first fluid pressure chamber.

29. A variable displacement vane pump, comprising:

a pump body;

a driving shaft supported on the pump body;

a rotor disposed within the pump body and rotatably driven by the driving shaft, the rotor including a plurality of vanes arranged in a circumferential direction of the rotor;

an annular cam ring disposed within the pump body so as to be swingable around a swing fulcrum, the cam ring cooperating with the rotor and the vanes to define a plurality of pump chambers on an inner circumferential side of the cam ring;

a first support member disposed at one axial end of the cam ring;

a second support member disposed at an opposite axial end of the cam ring;

a suction port and a discharge port which are disposed on at least one of the first and second support members, the suction port being open to a suction area in which a volume of each of the pump chambers is gradually increased with the rotation of the rotor, the discharge port being open to a discharge area in which the volume of each of the pump chambers is gradually decreased with the rotation of the rotor;

a seal disposed on an outer circumferential side of the cam ring so as to divide a space on the outer circumferential side of the cam ring into a first fluid pressure chamber and a second fluid pressure chamber, the first fluid pressure chamber being defined in a swing direction of the cam ring in which the cam ring is swung to cause increase in a flow rate of a working fluid which is discharged from the discharge port, the second fluid pressure chamber being defined in a swing direction of the cam ring in which the cam ring is swung to cause decrease in the flow rate of the working fluid which is discharged from the discharge port, the second fluid pressure chamber receiving a suction pressure; and cam ring biasing means for biasing the cam ring from a side of the second fluid pressure chamber toward a side of the first fluid pressure chamber.

30. The variable displacement vane pump as claimed in claim 29, wherein the cam ring is supported on a support surface which is inclined toward the side of the second fluid pressure chamber with respect to an imaginary reference plane which extends through a rotation axis of the driving shaft and a middle point between a terminal end of the suction port and a start end of the discharge port such that a distance between the support surface and the imaginary reference plane is gradually increased.

* * * * *